US010633612B2

(12) United States Patent
Shimura et al.

(10) Patent No.: US 10,633,612 B2
(45) Date of Patent: Apr. 28, 2020

(54) LUBRICANT COMPOSITION

(71) Applicant: NOK Klueber Co., Ltd., Tokyo (JP)

(72) Inventors: Akihiko Shimura, Kitaibaraki (JP); Yoshihito Tani, Kitaibaraki (JP); Toshio Nitta, Kitaibaraki (JP)

(73) Assignee: NOK Klueber Co., Ltd., Tokyo (JP)

( * ) Notice: Subject to any disclaimer, the term of this patent is extended or adjusted under 35 U.S.C. 154(b) by 0 days.

(21) Appl. No.: 15/146,441

(22) Filed: May 4, 2016

(65) Prior Publication Data

US 2016/0244690 A1 Aug. 25, 2016

Related U.S. Application Data

(63) Continuation of application No. 13/883,175, filed as application No. PCT/JP2011/071181 on Sep. 16, 2011, now abandoned.

(30) Foreign Application Priority Data

Nov. 5, 2010 (JP) ..... 2010-248964

(51) Int. Cl.

| | |
|---|---|
| ***C10L 1/22*** | (2006.01) |
| ***C10M 169/04*** | (2006.01) |
| ***C10M 133/42*** | (2006.01) |
| ***C10M 147/04*** | (2006.01) |
| ***C10M 161/00*** | (2006.01) |
| ***C10M 107/38*** | (2006.01) |

(52) U.S. Cl.

CPC ..... *C10M 169/04* (2013.01); *C10M 107/38* (2013.01); *C10M 133/42* (2013.01); *C10M 147/04* (2013.01); *C10M 161/00* (2013.01); *C10M 2201/041* (2013.01); *C10M 2207/023* (2013.01); *C10M 2213/043* (2013.01); *C10M 2213/062* (2013.01); *C10M 2213/0606* (2013.01); *C10M 2215/22* (2013.01); *C10M 2215/222* (2013.01); *C10N 2230/06* (2013.01); *C10N 2240/02* (2013.01); *C10N 2240/04* (2013.01); *C10N 2240/06* (2013.01); *C10N 2240/201* (2013.01)

(58) Field of Classification Search

CPC ..... C10M 105/52; C10M 115/08; C10M 2213/043

USPC ..... 508/256

See application file for complete search history.

(56) References Cited

U.S. PATENT DOCUMENTS 6,548,454 B1 4/2003 Yamamoto et al.
2007/0297704 A1* 12/2007 Mayston ..... F16C 33/201 384/276
2008/0167208 A1* 7/2008 Hashida ..... C10M 107/38 508/582
2008/0318819 A1* 12/2008 Saita ..... C10M 169/06 508/463
2010/0142872 A1* 6/2010 Egami ..... B82Y 30/00 384/462
2010/0210494 A1* 8/2010 Hishinuma ..... C10M 169/02 508/588

FOREIGN PATENT DOCUMENTS

| | | | |
|---|---|---|---|
| CN | 101128569 | A | 2/2008 |
| EP | 1878785 | A1 | 1/2008 |
| GB | 2329905 | A | 4/1999 |
| JP | S45-5595 | B | 2/1970 |
| JP | S61-34430 | U | 8/1986 |
| JP | S62-280294 | A | 12/1987 |
| JP | H05-310716 | A | 11/1993 |
| JP | H07-224049 | A | 8/1995 |
| JP | H11-246886 | A | 9/1999 |
| JP | 2001013351 | A | 1/2001 |
| JP | 2001-089778 | A | 4/2001 |
| JP | 2001-354986 | A | 12/2001 |
| JP | 2005-247971 | A | 9/2005 |
| JP | 2006-232921 | A | 9/2006 |
| JP | 2008-037892 | A | 2/2008 |
| JP | 2009-013350 | A | 1/2009 |
| JP | 2009-013351 | A | 1/2009 |
| JP | 2010-185043 | A | 8/2010 |
| WO | 2006/090779 | A1 | 8/2006 |

OTHER PUBLICATIONS

Appeal against Examiners Decision of Refusal No. 2015-10639 (Japanese Patent Application No. 2010-248964) dated Sep. 5, 2016.
International Search Report for PCT/JP2011/071181 dated Dec. 20, 2011 (English Translation).
International Search Report for PCT/JP2011/071181 dated Dec. 20, 2011.
OA CN Application No. 201180047168.2 dated Nov. 5, 2013.
Office Action for CN Application 201180047168.2 dated Jul. 16, 2014.
Daikin, "Product Information", retrieved from www.daikin.com/chm/products/pdfDown.php?url=pdf/tds/tds_dms-1_e.pdf, May 2, 2010.
Extended European Search Report dated Apr. 25, 2014 for EP Application 11837814.0-1352.
Office Action for JP Application 2010248964 dated Sep. 16, 2014.
Rejection Decision for CN 201180047168.2 dated Dec. 3, 2014.
Decision of Refusal dated Apr. 13, 2015 in corresponding Japanese Patent App. No. 2010-248964.
Appeal Decision No. 2015-10639 (Japanese Patent Application No. 2010-248964) dated Jan. 10, 2017.
Office Action for JP Application 2016-215811 dated Jul. 3, 2017.
Decision to Grant a Patent dated Sep. 4, 2017 in corresponding Japanese Application No. 2016-215811.

(Continued)

*Primary Examiner* — Prem C Singh
*Assistant Examiner* — Francis C Campanell
(74) *Attorney, Agent, or Firm* — Thompson Coburn LLP; William A. Holtz

(57) ABSTRACT

A lubricant composition includes a base oil and melamine cyanurate. The base oil includes a perfluoropolyether oil having a straight chain structure. The lubricant composition is for one of a resin-resin sliding section and a resin-metal sliding section. A melamine cyanurate content is within a range of 1-20% by mass with respect to a sum of the base oil and melamine cyanurate.

4 Claims, No Drawings

(56) References Cited

OTHER PUBLICATIONS

English translation of International Preliminary Report on Patentability for PCT/JP2011/071181 dated May 8, 2013.
English translation of Written Opinion of the International Searching Authority for PCT/JP2011/071181 dated Dec. 20, 2011.
Office Action for EP Application 11837814.0 dated Feb. 23, 2018.
Communication Under Rule 71(3) EPC for corresponding EP Application 11837814.0 dated May 17, 2018.

* cited by examiner

LUBRICANT COMPOSITION

CROSS-REFERENCE TO RELATED APPLICATIONS

This application is a continuation of U.S. application Ser. No. 13/883,175, filed on May 2, 2013, which is the U.S. National Stage application of International Patent Application No. PCT/JP2011/071181, filed on Sep. 16, 2011, which claims the benefit of Japanese Application No. 2010-248964, filed Nov. 5, 2010, all of which are incorporated by reference herein in their entireties.

TECHNICAL FIELD

The present invention relates to lubricant compositions, and, more specifically to lubricant compositions that can be suitably used for a sliding section between resin members (resin-resin) or between a resin member and a metal member (resin-metal).

BACKGROUND ART

In the related art, lubricant compositions containing base oils are often used for improving a sliding property between various members. Particularly, a lubricant composition containing a fluorine-based polymer as a base oil is used in a wide range of temperature from high to low temperatures, since it is chemically stable and has a low pour point due to a much greater binding energy between a fluorine atom and a carbon atom than a binding energy between a carbon atom and each of hydrogen, oxygen and chlorine atoms.

For example, Patent Document 1 discloses a grease composition suitable for a rolling bearing that contains a perfluoropolyether oil as a base oil and contains melamine cyanurate as a thickener with an amount of melamine cyanurate being at least 10% by mass with respect to the total of the grease composition.

Patent Document 2 discloses a lubricant composition containing perfluoropolyether and organic ultrafine particles (ultra-fine polymer).

Furthermore, Patent Document 3 discloses a fluorine-based grease obtained by adding at least one of an aliphatic dicarboxylic acid metal salt, a monoamide monocarboxylic acid metal salt and a monoestercarboxylic acid metal salt as a thickener to a perfluoropolyether base oil, thus having an improved wear resistance, leak resistance and cleanliness as well as cost effectiveness.

Recently, for automotive parts, household electric appliances, electronic information devices and office automation appliances, resin members are more commonly used as gears and sliding members as a result of efforts in reducing weight and cost.

As a lubricant composition which can be preferably used for a sliding section between resin members or between a resin member and a metal member, Patent Document 4 discloses a lubricating grease composition that contains a base oil such as poly-α-olefin, a thickener and a solid lubricant that includes melamine cyanurate (MCA) and polytetrafluoroethylene (PTFE), characterized in that a blending amount of a sum of MCA and PTFE with respect to the total weight of grease is within a range of 0.1-25% by weight and a blending ratio between MCA and PTFE is within a range of MCA/PTFE (ratio by weight)=0.05-50, and having a lubricating function (low dynamic friction coefficient) as well as a quiescence function (high static friction coefficient).

DOCUMENT LIST

Patent Document(s)

Patent Document 1: Japanese Laid-Open Patent Publication No. 2006-232921

Patent Document 2: Japanese Laid-Open Patent Publication No. H11-246886

Patent Document 3: Japanese Laid-Open Patent Publication No. 2001-354986

Patent Document 4: Japanese Laid-Open Patent Publication No. 2009-13351

SUMMARY OF INVENTION

Technical Problem

However, Patent Document 4 discloses using poly-α-olefin as a base oil, and thus a lubricant composition containing a fluorine-based polymer as a base oil and having a sufficient lubrication property (a decreased dynamic friction coefficient) has not yet been introduced.

Accordingly, it is an object of the invention to provide a lubricant composition containing a fluorine-based polymer as a base oil that can offer an improved lubrication property in the sliding between resin members (resin-resin) or between a resin member and a metal member (resin-metal).

Solution to Problem

To achieve the above object, according to an aspect of the invention, the present invention provides a lubricant composition described below.

(1) A lubricant composition comprising a base oil and melamine cyanurate, the base oil including a perfluoropolyether oil having a straight chain structure, the lubricant composition being for one of a resin-resin sliding section and a resin-metal sliding section, wherein a melamine cyanurate content is within a range of 1-20% by mass with respect to a sum of the base oil and melamine cyanurate.

(2) The lubricant composition according to sentence (1), wherein the melamine cyanurate content is within a range of 5-12% by mass with respect to a sum of the base oil and melamine cyanurate.

(3) The lubricant composition according to sentence (1) or (2), wherein the perfluoropolyether oil does not have a repeat unit represented by —$(CF_2O)$—.

(4) The lubricant composition according to any one of sentences (1) to (3), wherein the perfluoropolyether oil is represented by the following general formula (i):

$$F(CF_2CF_2CF_2O)_nCF_2CF_3 \quad \text{(i)},$$

where, in the above formula (i), n is an integer of 2 to 200.

(5) The lubricant composition according to any one of sentences (1) to (4), wherein an evaporation loss rate for the perfluoropolyether oil is less than or equal to 10% by mass at 200° C. for 100 hours.

(6) The lubricant composition according to any one of sentences (1) to (5), wherein the lubricant composition is for a one direction motion sliding section.

Advantageous Effects of Invention

According to an aspect of the invention, a lubricant composition is provided that can offer an improved lubrication property in the sliding between resin members (resin-resin) or between a resin member and a metal member (resin-metal).

DESCRIPTION OF THE PREFERRED EMBODIMENTS

A lubricant composition of the invention includes a base oil and melamine cyanurate, the base oil including a perfluoropolyether oil having a straight chain structure, the lubricant composition being for one of a resin-resin sliding section and a resin-metal sliding section, and a melamine cyanurate content is within a range of 1 to 20% by mass with respect to a sum of the base oil and melamine cyanurate. Hereinafter, each of the components of the lubricant composition of the invention will be described in detail.

[Base Oil]

According to the invention, the base oil includes a perfluoropolyether oil having a straight chain structure.

The perfluoropolyether oil having a straight chain structure is not particularly limited, and, preferably, a commonly known perfluoropolyether oil may be used. According to the invention, a perfluoropolyether oil (PFPE) represented by the following formula can be used.

$$F(CF_2CF_2CF_2O)_nCF_2CF_3 \quad \text{(i)},$$

where, in formula (i), n is an integer between 2 and 200.

The perfluoropolyether oil represented by general formula (i) can be obtained by, for example, anionically polymerizing 2,2,3,3-tetrafluorooxetane using a fluoride ion supplier such as cesium fluoride as a catalyst to obtain polyether containing a fluorinated acyl group and having —$(CH_2CF_2CF_2O)$— as a constituent unit, and then performing a fluorine gas treatment on the obtained polyether while irradiating an ultraviolet ray at about 160-300° C. (see Y. Ohsaka, Petrotech, 8, 840 (1985), Y. Ohsaka, T. Tozuka and S. Takaki (Daikin), Eur. Pat: Appl. 148482 (1985)). The perfluoropolyether oil represented by formula (i) may be PFPE-D, which is available on market, and, more specifically, DEMNUM (manufactured by Daikin Industries, Ltd.).

$$Rf^1O[CF_2CF_2O]_mRf^2 \quad \text{(ii)},$$

where, in formula (ii), m is an integer of 2 to 200, and $Rf^1$ and $Rf^2$, each independently, represent perfluoroalkyl groups having 1 to 5 carbon atoms.

The perfluoropolyether oil represented by formula (ii) is manufactured by, for example, anionically polymerizing, under a low temperature, a tetrafluoroethylene oxide using a fluoride ion supplier such as cesium fluoride as a catalyst and then performing a fluorine gas treatment on the obtained acid fluoride compound having a terminal-CFXCOF group (see formulae (I) and (II) indicated below). (See, for example, W. H. Gumprecht, ASLE Trans., 924 (1966), J. T. Hill, J. Macromol. Sci. Chem., A8, 499 (1974)). Note that, the perfluoroalkyl group having 1 to 5 carbons may be a perfluoromethyl group, a perfluoroethyl group, a perfluoropropyl group, a perfluorobutyl or a perfluoropentyl group. Specifically, a perfluoromethyl group and a perfluoroethyl group are preferable.

(I)

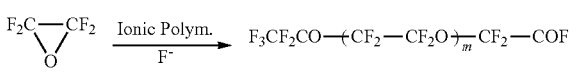

-continued (II)

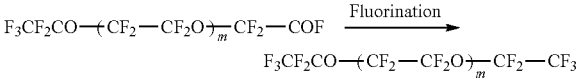

[CHEMICAL FORMULA 1]

(iii)

$$Rf^3O\,(CF_2CF_2O)_k\,(CF_2O)_lRf^4,$$

where, in formula (iii), k and l are numbers that satisfy k+l=3 to 200, and $Rf^3$ and $Rf^4$, each independently, represent perfluoroalkyl groups having 1 to 5 carbons. Particularly, those with k:l=10:90 to 90:10 and randomly bonded are preferable.

The perfluoropolyether oil represented by formula (iii) can be obtained by causing tetrafluoroethylene to be subjected to a catalyst treatment to react with oxygen using an ultraviolet ray, and then reducing the thus obtained polyperoxide, which is an intermediate, to obtain polyether having acid fluoride, and thereafter performing a fluorination treatment under ultraviolet irradiation (see reaction formula (III) below) (see, for example, D. Sianesi, A. Pasetti, C. Corti, Makromol. Chem, 86, 308 (1965)). Specifically, it is PFPE-Z, which is available on market, and more specifically, Fomblin M (manufactured by SolvaySolexis company). Note that, the perfluoroalkyl group having 1 to 5 carbons may be the groups similar to those described above.

[CHEMICAL FORMULA 2]

(III)

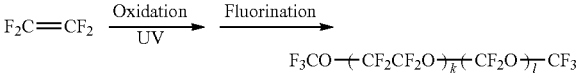

In the present invention, the aforementioned perfluoropolyether oil may be used alone or used as a mixture of a plurality of types thereof, but from a heat resistance point of view, a perfluoropolyether oil with no repeat unit represented by —(CF2O)— is preferable, and a perfluoropolyether oil represented by general formula (i) is particularly preferable. The perfluoropolyether oil has an evaporation loss rate (200° C., 100 hours) of preferably less than or equal to 30% by mass, more preferably less than or equal to 10% by mass, and further preferably less than or equal to 5% by mass. When the evaporation loss rate is greater than 30% by mass, the perfluoropolyether oil may turn into gas and move outside the system, thus impairing a lubricating function. The perfluoropolyether oil has a kinematic viscosity (40° C.) within a range of normally 10-2000 $mm^2/s$, and preferably 10-1500 $mm^2/s$, but not limited thereto. In a case where the kinematic viscosity is less than 10 $mm^2/s$, the perfluoropolyether oil easily vaporizes and thus easily disperses out of the system, and in a case where it is greater than 2,000 $mm^2/s$, since the fluidity decreases, it becomes difficult to be self-supplied to the sliding section and a lubrication performance may become insufficient.

The base oil as used herein may include an oily ingredient other than the perfluoropolyether oil, as long as an object of the invention is not impaired. The oily ingredients that can be used in combination may be at least one kind of composite oil selected from a synthetic hydrocarbon oil, an ester-based synthetic oil, an ether-based synthetic oil and a glycol-based synthetic oil.

The synthetic hydrocarbon oil may be at least one kind selected from poly-α-olefin, an ethylene-α-olefine copolymer, polybutene, alkylbenzene, alkyl naphthalene, or the like.

The ester-based synthetic oil may be, for example, a mixture of at least one kind or two kinds or more selected from esters such as diester, polyol esters, an aromatic ester, or the like.

The ether-based synthetic oil may be at least one kind selected from alkyl diphenyl ether, or the like.

The glycol-based synthetic oil may be at least one kind selected from polyethylene glycol, polypropylene glycol, or the like.

When other oily ingredients as described above are used in combination, a perfluoropolyether oil content in the base oil is preferably greater than or equal to 80% by mass and more preferably greater than or equal to 90% by mass. In a case where the perfluoropolyether oil content in the base oil is less than 80% by mass, the heat resistance of the base oil may be degraded. Also, in a case where other oily ingredients as described above are used in combination, an evaporation loss rate (200° C., 100 hours) of the whole base oil is preferably less than or equal to 30% by mass, more preferably less than or equal to 10% by mass, and further preferably less than or equal to 5% by mass.

[Melamine Cyanurate]

Melamine cyanurate used herein is not particularly limited, and, a commonly known melamine cyanurate may be used. Specifically, those described in, for example, Japanese Patent Publication No. S45-5595, Japanese Patent Publication No. S61-34430, Japanese Laid-Open Patent Publication H5-310716, Japanese Laid-Open Patent Publication H07-224049, etc., can be preferably used. Products available on market include, for example, MCA-1 (manufactured by Mitsubishi Chemical Corporation) and MC600, MC860, MC4000, MC6000 (each manufactured by Nissan Chemical Industries, Ltd.).

Although an average particle diameter of melamine cyanurate is not particularly limited, it is preferably 0.1 to 50 μm and more preferably 1 to 15 μm. The term "average particle diameter" used herein is defined as a median diameter (50% particle diameter) of a volume-based particle size distribution obtained by a particle size distribution measuring apparatus which uses a laser diffraction scattering method as a principle of measurement. Out of this range, a lubrication performance (an effect of reducing a dynamic friction coefficient) may decrease.

The melamine cyanurate content with respect to the total with the base oil is preferably 1-20% by mass, more preferably 2.5-15% by mass, and particularly preferably 5-12% by mass. In a case where melamine cyanurate is less than 1% by mass, a thickening effect on the base oil may not be sufficient and the base oil may flow out of the sliding system. In a case where it is greater than 20% by mass, the friction coefficient may increase.

[Other Component]

A solid lubricant other than melamine cyanurate, an antioxidant, an extreme pressure agent, an anti-rust agent, an anti-corrosion agent, a viscosity index improver, an oiliness agent, etc., may be appropriately selected and added to the grease composition of the present invention, as long as an advantage of the invention is not impaired.

The solid lubricant other than melamine cyanurate may be, for example, other solid lubricants such as polytetrafluoroethylene (PTFE), sodium sebacate, carbon black, graphite, molybdenum disulfide, organo-molybdenum, graphite, boron nitride, nitride silane, or the like. However, among the above solid lubricants, for example, it is not preferable to use sodium sebacate, carbon black, or the like, which may cause an increase in the friction coefficient.

The antioxidant may be, for example, a phenolic antioxidant such as 2,6-di-t-butyl-4-methyl phenol and 4,4'-methylene bis(2,6-di-t-butyl phenol) and an amine-based antioxidant such as alkyl diphenylamine (the alkyl group has a number of carbons 4 to 20), triphenyl amine, phenyl-α-naphthylamine, phenothiazine, alkylating phenyl-α-naphthylamine, phenothiazine and alkylated phenothiazine.

The extreme pressure agent may be, for example, a phosphorus compound such as phosphate esther, phosphite and amine phosphate esther, a sulfur compound such as sulfides and disulfides, a chlorine compound such as chlorinated paraffin and chlorinated diphenyl, and a metal organic compound such as dialkyl dithiophosphoric acid zinc (ZnDTP) and dialkyl dithiocarbamic acid molybdenum (MoDTP).

The anti-rust agent may be, for example, fatty acid, fatty acid soap, alkyl sulfonate, fatty acid amine, oxidized paraffin, polyoxyethylene alkyl ether, or the like.

The anti-corrosion agent may be, for example, benzotriazole, benzimidazole, thiadiazole or the like.

The viscosity index improver may be a polymethacrylate, an ethylene-propylene copolymer, polyisobutylene, polyalkyl styrene, a styrene-isoprene copolymer hydride, or the like.

The oiliness agent may be, for example, fatty acid, higher alcohol, polyhydric alcohol, polyhydric alcohol ester, aliphatic ester, aliphatic amine, fatty acid monoglyceride, or the like.

Note that, each of the aforementioned additives may be used alone or in any combination of two or more of them. Further, these components are preferably within a range of 0-100 parts by mass, and further preferably, 0-50 parts by mass with respect to a total amount of the base oil and melamine cyanurate, which is 100 parts by mass. When a blending amount of the additives exceeds 100 parts by mass, a lowering effect of a dynamic friction coefficient may decrease.

The lubricant composition of the invention can be prepared by mixing the aforementioned base oil, melamine cyanurate and other components, if applicable, using a normal mixing means. The mixing means may preferably be a three roll mill or a high-pressure homogenizer, but it is not particularly limited thereto.

The lubricant composition of the invention has an improved lubrication property for the sliding between resin members (resin-resin) the sliding between a resin member and a metal member (resin-metal). Note that, in the present invention, "resin" includes "rubber".

Other than rubber, the resin for which the lubricant composition of the invention can be applied may be polyethylene (PE), polypropylene (PP), an ABS resin (ABS), polyacetal (POM), nylon (PA), polycarbonate (PC), a phenol formaldehyde resin (PF), polyethylene terephthalate (PET), polybutylene terephthalate (PBT), polyphenylene sulfide (PPS), polyethersulfone (PES), polyimide (PI) and polyether ether ketone (PEEK), but it is not particularly limited thereto.

Rubber may be a nitrile rubber (NBR), a hydrogenated nitrile rubber (HNBR), an acrylic rubber (ACM), a styrene-butadiene rubber (SBR), a silicone rubber (VMQ), a fluorine rubber (FKM), an ethylene propylene rubber (EPDM), a chloropropylene rubber (CR), an urethane rubber (U), a butadiene rubber (BR), a butyl rubber (IIR), an isoprene rubber (IR), but it is not limited there to. The metal may be iron, aluminum and copper, but not limited thereto.

Examples

Hereinafter, the invention will be described in a more detailed manner with reference to examples representative of the invention which may be embodied in various forms. Thus, specific compositional, structural, functional, and procedural details disclosed in the following examples are not to be interpreted as limiting. It is to be noted that, in the examples below, compositions are represented in % by mass with respect to the total composition.

(1) Preparation of Lubricant Composition

Lubricant compositions having compositions indicated in Tables 1 to 5 were prepared respectively by combining a solid lubricant with a perfluoropolyether oil and sufficiently kneading using a three roll mill or a high-pressure homogenizer.

(Remarks)

$F(CF_2CF_2CF_2O)_{2-100}C_2F_5$: manufactured by Daikin Industries, Ltd., DEMNUM S200, 40° C. kinematic viscosity: 200 $mm^2/s$, Evaporation loss rate (200° C., 100 hours): 0.4% by mass RfO $[CF(CF_3)CF_2O]_m$Rf: manufactured by NOK Klueber Co., Ltd., BARRIERTA J400, 40° C. kinematic viscosity: 400 $mm^2/s$, Evaporation loss rate (200° C., 100 hours): 2% by mass MCA (melamine cyanurate) 1: manufactured by Nissan Chemical Industries, Ltd., MC6000, Average particle diameter $D_{50}$: Approx. 2 μm, $D_{90}$: Approx. 9 μm MCA2: manufactured by Nissan Chemical Industries, Ltd., MC4000, Average particle diameter $D_{50}$: 13 μm, $D_{90}$: 30 μm Sodium sebacate: manufactured by Hokoku Corporation, SA-NA Graphite: manufactured by Nihon Graphite Industries, ltd., CB150, Average particle diameter 4 μm PTFE (polytetrafluoroethylene): manufactured by Daikin Industries, Ltd., LUBRON L2

(2) Testing Method for Lubricant Composition (Friction Coefficient)

A friction coefficient is defined as an average value of dynamic friction coefficients measured using a PIN on DISK testing machine under the following conditions for 30 minutes. The lubricant composition was tested by applying 5 mg of lubricant composition to an upper specimen (cylinder type specimen).

Upper Specimen:

cylinder type (ϕ 10×10 mm)

iron: S45C polyacetal (POM): resin rod manufactured by MISUMI Corporation polytetrafluoroethylene (PTFE): resin rod manufactured by MISUMI Corporation Lower Specimen: Plate Type iron: S45C polyimide (PI): manufactured by Toray DUPONT, Kapton 100H Test Condition temperature: 130° C.

Load: 600 gf

Sliding velocity: 360 $mm^2/s$

Test time: 30 minutes (3) Test Result

Table 1 shows a result of measurement of a dynamic friction coefficient for the sliding between iron (S45C) and iron (S45C), Tables 2 and 3 show results of measurement of a dynamic friction coefficient for the sliding between polyacetal (POM) and polyimide (PI), and Tables 4 and 5 show results of measurement of a dynamic friction coefficient for the sliding between polytetrafluoroethylene (PTFE) and polyimide (PI).

As can be seen from Table 1, when a lubricant composition was used for the sliding between metals, there was no significant change in a value of the friction coefficient irrespective of an increase or a decrease in a solid lubricant content.

On the other hand, as can be seen from Tables 2 to 5, the lubricant composition of the invention has an improved lubrication property since the friction coefficients for the sliding between polyacetal (POM) and polyimide (PI) and the sliding between polytetrafluoroethylene (PTFE) and polyimide (PI) are 0.026-0.032 and 0.113-0.121, respectively. Also, it can be seen that the compound in which melamine cyanurate is 5-15% by mass of the total weight of melamine cyanurate and the base oil has a particularly improved lubrication property.

By comparing Example 4 with Comparative Example 8, it can be seen that the lubricant composition of the invention has a more improved lubrication performance than the lubricant composition containing a perfluoropolyether base oil (base oil 2) having a branched chain structure.

TABLE 1

PIN ON DISK TEST RESULT: SLIDING BETWEEN IRON (S45C) AND IRON (S45C)

| | | No. | | |
|---|---|---|---|---|
| | | COMPARATIVE EXAMPLE 1 | COMPARATIVE EXAMPLE 2 | COMPARATIVE EXAMPLE 3 |
| BASE OIL 1 | $F(CF_2CF_2CF_2O)_nC_2F_5$ | 95 | 90 | 85 |
| SOLID LUBRICANT | MCA1 | 5 | 10 | 15 |
| FRICTION COEFFICIENT | | 0.13 | 0.13 | 0.14 |

TABLE 2

PIN ON DISK TEST RESULT: SLIDING BETWEEN POLYACETAL (POM) AND POLYIMIDE (PI)

| | | No. | | | | | | | | | | |
|---|---|---|---|---|---|---|---|---|---|---|---|---|
| | | EXAMPLE 1 | EXAMPLE 2 | EXAMPLE 3 | EXAMPLE 4 | EXAMPLE 5 | EXAMPLE 6 | EXAMPLE 7 | EXAMPLE 8 | EXAMPLE 9 | EXAMPLE 10 | EXAMPLE 11 |
| BASE OIL 1 | $F(CF_2CF_2CF_2O)_nC_2F_5$ | 97.5 | 95 | 92.5 | 90 | 89 | 88 | 85 | 81 | 80 | 95 | 90 |
| BASE OIL 2 | $RfO(CF(CF_3)CF_2O)mRf$ | | | | | | | | | | | |
| SOLID | MCA 1 | 2.5 | 5 | 7.5 | 10 | 11 | 12 | 15 | 19 | 20 | | |

TABLE 2-continued

| PIN ON DISK TEST RESULT: SLIDING BETWEEN POLYACETAL (POM) AND POLYIMIDE (PI) | | | | | | | | | | | | |
|---|---|---|---|---|---|---|---|---|---|---|---|---|
| | | No. | | | | | | | | | | |
| | | EXAMPLE 1 | EXAMPLE 2 | EXAMPLE 3 | EXAMPLE 4 | EXAMPLE 5 | EXAMPLE 6 | EXAMPLE 7 | EXAMPLE 8 | EXAMPLE 9 | EXAMPLE 10 | EXAMPLE 11 |
| LUBRICANT | MCA2 | | | | | | | | | | 5 | 10 |
| | SODIUM SEBACATE | | | | | | | | | | | |
| | GRAPHITE | | | | | | | | | | | |
| | PTFE | | | | | | | | | | | |
| FRICTION COEFFICIENT | | 0.026 | 0.024 | 0.022 | 0.021 | 0.023 | 0.024 | 0.030 | 0.031 | 0.032 | 0.025 | 0.023 |

TABLE 3

| PIN ON DISK TEST RESULT: SLIDING BETWEEN POLYACETAL (POM) AND POLYIMIDE (PI) | | | | | | | |
|---|---|---|---|---|---|---|---|
| | | No. | | | | | |
| | | COMPARATIVE EXAMPLE 4 | COMPARATIVE EXAMPLE 5 | COMPARATIVE EXAMPLE 6 | COMPARATIVE EXAMPLE 7 | COMPARATIVE EXAMPLE 8 | COMPARATIVE EXAMPLE 9 |
| BASE OIL 1 | $F(CF_2CF_2CF_2O)_nC_2F_5$ | 75 | 70 | 95 | 95 | | 89 |
| BASE OIL 2 | $RfO(CF(CF_3)CF_2O)mRf$ | | | | | 90 | |
| SOLID LUBRICANT | MCA 1 | 25 | 30 | | | 10 | |
| | SODIUM SEBACATE | | | 5 | | | |
| | GRAPHITE | | | | 5 | | |
| | PTFE | | | | | | 11 |
| FRICTION COEFFICIENT | | 0.034 | 0.035 | 0.041 | 0.045 | 0.040 | 0.031 |

TABLE 4

| PIN ON DISK TEST RESULT: SLIDING BETWEEN POLYTETRAFLUOROETHYLENE (PTFE) AND POLYIMIDE (PI) | | | | | | | | | | |
|---|---|---|---|---|---|---|---|---|---|---|
| | | No. | | | | | | | | |
| | | EXAMPLE 12 | EXAMPLE 13 | EXAMPLE 14 | EXAMPLE 15 | EXAMPLE 16 | EXAMPLE 17 | EXAMPLE 18 | EXAMPLE 19 | EXAMPLE 20 |
| BASE OIL 1 | $F(CF_2CF_2CF_2O)_nC_2F_5$ | 97.5 | 95 | 92.5 | 90 | 89 | 88 | 85 | 81 | 80 |
| BASE OIL 2 | $RfO(CF(CF_3)CF_2O)mRf$ | | | | | | | | | |
| SOLID LUBRICANT | MCA 1 | 2.5 | 5 | 7.5 | 10 | 11 | 12 | 15 | 19 | 20 |
| | SODIUM SEBACATE | | | | | | | | | |
| | GRAPHITE | | | | | | | | | |
| | PTFE | | | | | | | | | |
| FRICTION COEFFICIENT | | 0.113 | 0.110 | 0.088 | 0.102 | 0.112 | 0.115 | 0.119 | 0.120 | 0.121 |

TABLE 5

| PIN ON DISK TEST RESULT: SLIDING BETWEEN POLYTETRAFLUOROETHYLENE (PTFE) AND POLYIMIDE (P1) | | | | | | | |
|---|---|---|---|---|---|---|---|
| | | No. | | | | | |
| | | COMPARATIVE EXAMPLE 10 | COMPARATIVE EXAMPLE 11 | COMPARATIVE EXAMPLE 12 | COMPARATIVE EXAMPLE 13 | COMPARATIVE EXAMPLE 14 | COMPARATIVE EXAMPLE 15 |
| BASE OIL 1 | $F(CF_2CF_2CF_2O)_nC_2F_5$ | 75 | 70 | 95 | 95 | | 89 |
| BASE OIL 2 | $RfO(CF(CF_3)CF_2O)mRf$ | | | | | 90 | |
| SOLID LUBRICANT | MCA 1 | 25 | 30 | | | 10 | |
| | SODIUM SEBACATE | | | 5 | | | |
| | GRAPHITE | | | | 5 | | |
| | PTFE | | | | | | 11 |
| FRICTION COEFFICIENT | | 0.130 | 0.140 | 0.150 | 0.160 | 0.152 | 0.122 |

INDUSTRIAL APPLICABILITY

The lubricant composition of the invention provides an improved lubrication property for the sliding between resin members (resin-resin) or the sliding between a resin member and a metal member (resin-metal), and finds applicability in various fields.

For example, the lubricant composition of the invention can be preferably used for the lubrication or protection of sliding sections or contact sections between solid bodies such as rolling bearings, plain bearings, sintered bearings, gears, valves, cocks, oil seals, parts for office appliances such as copying machines and printers, fuser rolls, fuser belt parts, running system parts, braking system parts such as ABSs, steering system parts, drive system parts such as transmissions, auxiliary parts for automobiles such as power window motors, power seat motors and sunroof motors, and electric contacts. More specifically, the lubricant composition is applicable to parts described below.

For automobiles, the parts may be rolling bearings and plain bearings of electric radiator fan motors, fan couplings, electronically controlled EGRs, electronically controlled throttle valves, alternators, idler pulleys, electric brakes, hub units, water pumps, power windows, windshield wipers and electric power steering systems that require heat resistance and shear stability. Further, the parts may be electric contact portions of control switches for gear portion automatic transmission, lever control switches, push switches or the like that require heat resistance, shear stability and wear resistance. Further, the lubricant composition may be used for rubber sealing parts that require heat resistance and shear stability such as X ring portions of viscous couplings and O rings of exhaust brakes, and rolling bearings, plain bearings, gears or sliding portion of headlights, seats, ABSs, door locks, door hinges, clutch boosters, two part fly wheels, window regulators, ball joints, clutch boosters and the like.

For office appliances, the parts may be rolling bearings, plain bearings, resin films, resin sliding portions or gear portions that require heat resistance and wear resistance of fuser rolls, fuser belts and the like of copying machines, laser beam printers and the like.

For home electric appliances and information equipment, the parts may be rolling bearings, plain bearings, oil seals and the like of cooling fans of PCs, vacuum cleaners and washing machines.

For resin manufacturing apparatuses, the parts may be rolling bearings, plain bearings, chains, pins, oil seals, gears and the like of film tenters, film laminators and banbury mixer that require heat resistance and load resistance.

For paper manufacturing apparatuses, the parts may be rolling bearings, plain bearings, pins, oil seals, gears and the like in corrugate machines or the like that require heat resistance and wear resistance.

For a timber processing apparatuses, the parts may be rolling bearings, plain bearings, pins, oil seals, gears and the like in continuous presses or the like that require heat resistance and wear resistance.

For apparatuses for food products, the parts may be rolling bearings or the like of linear guides of bread-baking machines, ovens and the like that require heat resistance and wear resistance.

In addition, the lubricant composition may be used for rolling bearings and plain bearings that require a low friction coefficient and sliding portions of hinges of mobile telephones that require shear stability and wear resistance. Further, it can also be used for rolling bearings and gears in vacuum pumps of semiconductor manufacturing apparatuses, liquid crystal manufacturing apparatuses and electron microscopes, and rolling bearings of electronically controlled crossing gates.

What is claimed is:

1. A method of lubricating sliding sections, the method comprising lubricating the sliding sections with a lubricant composition consisting of a base oil and melamine cyanurate, wherein the base oil comprises a perfluoropolyether oil having a straight chain structure, wherein the perfluoropolyether oil is represented by the following general formula (i):

$$F(CF_2CF_2CF_2O)_nCF_2CF_3 \quad \text{(i)},$$

wherein, in the above formula (i), n is an integer of 2 to 200, wherein the evaporation loss rate for the perfluoropolyether oil is less than or equal to 5% by mass at 200° C. for 100 hours, wherein the perfluoropolyether oil content is within a range of 80-97.5% by mass with respect to the sum of the perfluoropolyether oil and melamine cyanurate, wherein the melamine cyanurate content is within a range of 5-12% by mass with respect to the sum of the base oil and melamine cyanurate, wherein the average particle diameter of the melamine cyanurate is 0.1 to 50 μm, and wherein the lubricated sliding sections are resin-resin sliding sections and wherein the resin is selected from the group consisting of polyethylene (PE), polypropylene (PP), ABS resin (ABS), polyacetal (POM), nylon (PA), polycarbonate (PC), phenol formaldehyde resin (PF), polyethylene terephthalate (PET), polybutylene terephthalate (PBT), polyphenylene sulfide (PPS), polyethersulfone (PES), polyimide (PI), polyether ether ketone (PEEK) or polytetrafluoroethylene (PTFE).

2. The method of claim 1, wherein the melamine cyanurate content is within a range of 5-11% by mass with respect to the sum of the base oil and melamine cyanurate.

3. The method of claim 1, wherein the lubricated sliding sections are one direction motion sliding sections.

4. The method of claim 2, wherein the lubricated sliding sections are one direction motion sliding sections.

* * * * *